US007179063B2

(12) United States Patent
Cäsar et al.

(10) Patent No.: US 7,179,063 B2
(45) Date of Patent: Feb. 20, 2007

(54) RECIPROCATING-PISTON MACHINE WITH A SLIDING SLEEVE

(75) Inventors: Roland Cäsar, Stuttgart (DE); Peter Kuhn, Weinheim (DE)

(73) Assignees: DaimlerChrysler AG, Stuttgart (DE); ObristEngineering GmbH, Lustenau (AT)

( * ) Notice: Subject to any disclaimer, the term of this patent is extended or adjusted under 35 U.S.C. 154(b) by 622 days.

(21) Appl. No.: 10/713,558

(22) Filed: Nov. 14, 2003

(65) Prior Publication Data

US 2004/0120830 A1 Jun. 24, 2004

Related U.S. Application Data

(63) Continuation-in-part of application No. PCT/EP02/02891, filed on Mar. 15, 2002.

(30) Foreign Application Priority Data

May 16, 2001 (DE) ..... 101 24 033

(51) Int. Cl.

| | |
|---|---|
| ***F04B 1/12*** | (2006.01) |
| ***F04B 1/26*** | (2006.01) |
| ***F01M 1/00*** | (2006.01) |
| ***F01B 3/00*** | (2006.01) |
| ***F01B 9/02*** | (2006.01) |

(52) U.S. Cl. ..... 417/269; 417/222.2; 184/6.17; 92/12.2; 92/13

(58) Field of Classification Search ..... 417/269, 417/222.2; 184/6.17; 92/12.2, 13
See application file for complete search history.

(56) References Cited

U.S. PATENT DOCUMENTS

| | | | | |
|---|---|---|---|---|
| 5,647,266 | A * | 7/1997 | Claas | 92/71 |
| 6,099,262 | A * | 8/2000 | Iino et al. | 417/269 |
| 6,129,532 | A * | 10/2000 | Kato et al. | 418/55.6 |
| 6,164,252 | A * | 12/2000 | Kuhn et al. | 123/56.3 |
| 6,179,578 | B1 * | 1/2001 | Kayukawa et al. | 417/313 |

FOREIGN PATENT DOCUMENTS

| | | |
|---|---|---|
| DE | 197 49 727 | 6/1999 |

* cited by examiner

*Primary Examiner*—Ehud Gartenberg
*Assistant Examiner*—Jessica Frantz
(74) *Attorney, Agent, or Firm*—Klaus J. Bach

(57) ABSTRACT

In a reciprocating-piston machine, in particular a refrigerant compressor for a motor vehicle air-conditioning system, including a machine shaft rotatably supported in a housing, a plurality of pistons arranged circularly around the machine shaft in the housing, and an annular pivoting disc driven by the machine shaft and engaging the pistons via a joint arrangement, the pivoting disc being connected in an articulated manner to the machine shaft via a driver for transmitting the machine shaft drive forces to the pistons and mounted on a machine shaft-supported sliding body so as to be pivotable about a hinge axis oriented transversely to the machine shaft, the sliding body has an elongated recess which is open at one axial end for receiving the driver and the sliding body further includes at its inside adjacent the machine shaft a cavity, which is in communication with a bore forming a discharge passage extending through the machine shaft.

4 Claims, 3 Drawing Sheets

RECIPROCATING-PISTON MACHINE WITH A SLIDING SLEEVE

This is a continuation-in-part application of international application PCT/EP02/02891 filed Mar. 15, 2002 and claiming the priority of German application DE 101 24 033.3 filed May 16, 2001.

BACKGROUND OF THE INVENTION

The invention relates to a reciprocating-piston machine, particularly a refrigerant compressor for an air conditioning system of a motor vehicle.

DE 197 49 727 C2 discloses a reciprocating-piston machine of the type which comprises a machine housing, in which a plurality of pistons are arranged in a circular arrangement around a rotating drive shaft. The drive force is transmitted from the drive shaft, via a driver, to an annular pivoting disc and from the latter to the pistons, which are supported so as to be movable parallel to the machine shaft. The annular pivoting disc is mounted pivotably on a sleeve supported on the drive shaft so as to be linearly displaceable on the drive shaft. An elongated hole, through which the driver extends, is provided in the sleeve, so that the axial movability of the sleeve on the drive shaft is limited by the dimensions of the elongated hole. During assembly, the driver is inserted through the elongated hole. The drive shaft, driver, sliding sleeve and pivoting disc are arranged in a so-called drive space, in which gaseous working medium of the reciprocating-piston machine is present at a specific pressure. The delivery volume and consequently the delivery capacity of the reciprocating-piston machine are dependent on the pressure ratio between the suction side and pressure side of the pistons or, correspondingly, dependent on the pressures in the cylinders, on the one hand, and in the drive space, on the other hand.

It is the object of the invention to provide a reciprocating-piston machine, in which assembly is simplified and which has an improved operating behavior.

SUMMARY OF THE INVENTION

In a reciprocating-piston machine, in particular a refrigerant compressor for a motor vehicle air-conditioning system, including a machine shaft rotatably supported in a housing, a plurality of pistons arranged circularly around the machine shaft in the housing, and an annular pivoting disc driven by the machine shaft and engaging the pistons via a joint arrangement, the pivoting disc being connected in an articulated manner to the machine shaft via a driver for transmitting the machine shaft drive forces to the pistons and mounted on a machine shaft-supported sliding body so as to be pivotable about a hinge axis oriented transversely to the machine shaft, the sliding body has an elongated recess which is open at one axial end for receiving the driver and the sliding body further includes at its inside adjacent the machine shaft a cavity, which is in communication with a bore forming a discharge passage extending through the machine shaft.

The sliding body is configured preferably as a sleeve with an opening in the form of an elongated hole open at one end. The sleeve can consequently be slipped over the machine shaft and driver, even when these are fixedly connected to one another. In the assembled state, the driver projects through the elongated hole and is thus surrounded by the sleeve on several sides. The machine shaft, pivoting disk and sliding body are arranged within the housing of the reciprocating-piston machine preferably at least partially in the drive space in which the working medium to be compressed is present.

In a refinement of the invention, the sliding body has, in the region of the opening, a first stop face acting against the driver and, on one axial end face, a second stop face abutting a holding element located on the machine shaft. The stop faces limit the movement of the sliding body on the machine shaft. They are arranged, with respect to the driver, in each case on the same side of the sliding body in the axial direction. The end positions of the sliding body are defined by the stop faces. The first extreme position is reached when the pivoting disc and the machine shaft form a minimum angle and the pistons have a maximum stroke during rotation of the pivoting disc. In this case, the first stop face butts against the driver. The second end position is reached when the pivoting disc forms at least approximately a right angle with the machine shaft and therefore assumes a "neutral position", in which the pistons of the reciprocating-piston machine are not moved by the pivoting disk. In this case, the second stop face butts against the holding element located on the machine shaft. The holding element is configured preferably as a retaining ring releasable from the machine shaft.

In a further refinement of the invention, a spring element, in particular a weak cup spring, is arranged between the holding element and the second stop face of the sliding body. The spring element is preferably assigned to the holding element in such a way that, when the sliding body completely compresses presses the spring element with its second stop face, the pivoting disc assumes its neutral position. The spring element is active preferably only when the sliding body is in the vicinity of its second end position. In a modified exemplary embodiment, the spring element serves continuously for the balancing of forces on the sliding body.

The reciprocating-piston machine according to the invention is also distinguished in that the sliding body, at its inside facing the machine shaft, forms a cavity, to which a passage extends, in particular an discharge passage, which passes through the machine shaft. The passage serves preferably for the discharge of working medium from the drive space, for a corresponding pressure compensation. The cavity provided in the sliding body is formed preferably by at least one groove formed on the inside of the sliding body and guides the flow entering the passage. As a result of the joint rotation of the sliding body with the machine shaft, a centrifugal force is exerted on the working medium located in the cavity. A phase separation of a substance mixture flowing through the cavity may take place within the cavity.

In a refinement of the invention, the cavity has an orifice to a drive space of the reciprocating-piston machine, the orifice being arranged at a distance, in the direction of the axis of rotation of the machine shaft, from the discharge opening of the passage provided in the machine shaft. The working medium supplied to the cavity first passes via the orifice into the cavity, is guided in the latter for some distance parallel to the axis of rotation of the machine shaft and subsequently is discharged. The liquid and gaseous constituents of the working medium are separated from one another in the cavity, in particular lubricants and other liquids are precipitated from a gaseous working medium and may be returned into the drive space as a result of gravitational influences.

In a further refinement of the invention, the orifice is arranged in the region of the discharge opening. This results in a simple way in a relatively large orifice which is arranged at a sufficient distance from the exit of the discharge opening.

The various features will become more readily apparent from the description on the basis of the drawings. Actual exemplary embodiments of the invention are illustrated in simplified form in the drawings and are explained in more detail in the following description.

DESCRIPTION OF PREFERRED EMBODIMENTS

Figure 1:
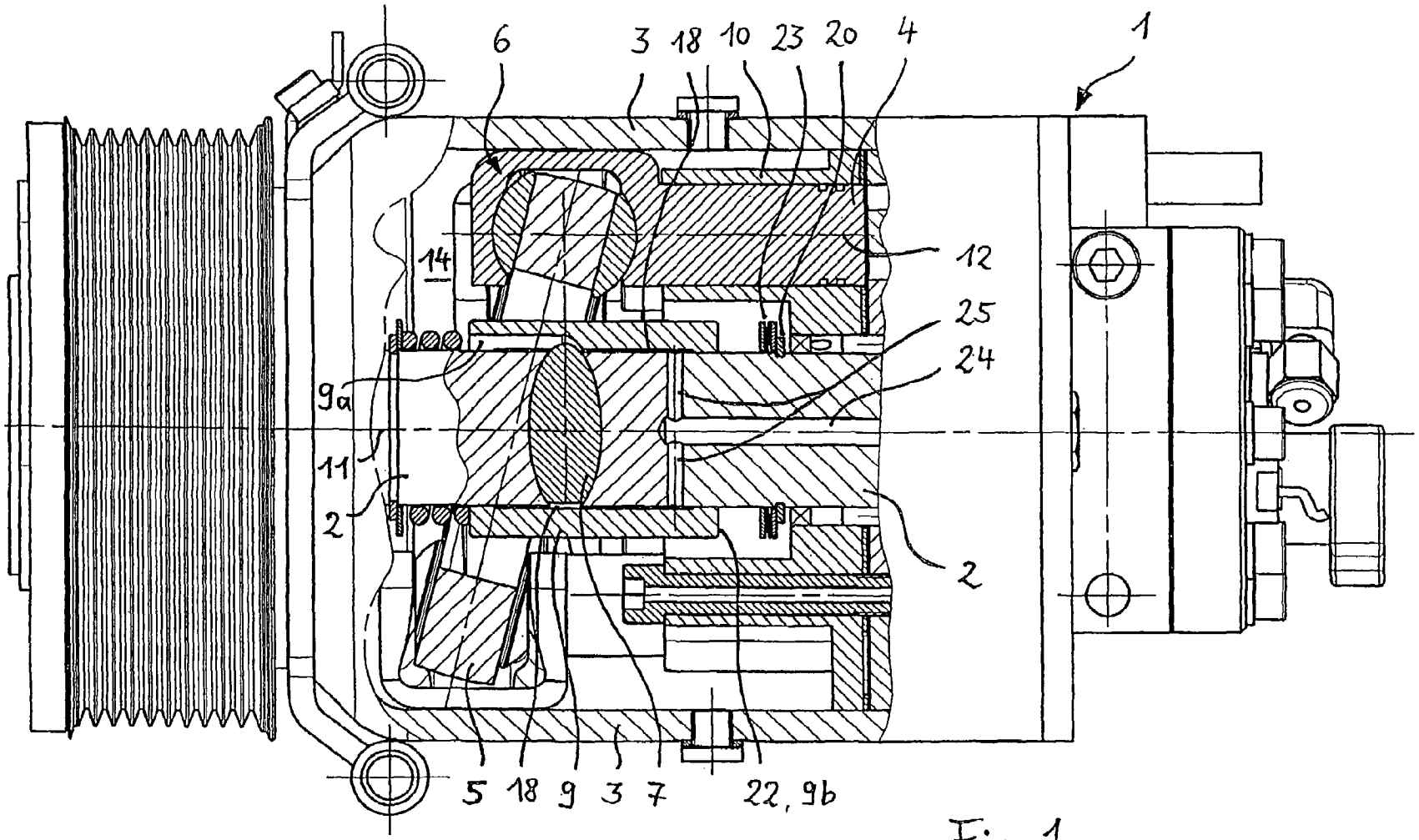
FIG. 1 shows a longitudinal sectional view of a reciprocating-piston machine according to the invention.

FIG. 1 is a longitudinal sectional view through a reciprocating-piston machine 1 in the form of a refrigerant compressor for a motor vehicle air-conditioning system. The reciprocating-piston machine 1 has a plurality of pistons 4 arranged in a machine housing 3. All the piston axes 12 are arranged at a fixed distance from the axis of rotation 11, that is to say they are disposed geometrically around the machine shaft 2 on a cylinder envelope. The pistons 4 are guided in cylindrical sleeves 10, in which cylindrical compression spaces 13 are formed. The pistons 4 separate the compression spaces 13 from a so-called drive space 14 ("crankcase"). All the piston axes 12 are oriented parallel to the axis of rotation 11 of the machine shaft. The rotational movement of the machine shaft is converted into a translational movement of the pistons 4 via a force transmission arrangement explained in more detail below.

A sliding body in the form of a sliding sleeve 9 is axially movably supported on the machine shaft 2. An annular pivoting disc 5 is mounted on the sliding sleeve 9, the pivoting disc 5 being axially displaceable jointly with the sliding sleeve 9, on the machine shaft 2. Two short pins 8*a* are attached to the sliding sleeve 9 on opposite sides and form a pivot axis 8, which is oriented transversely to the axis of rotation 11 of the machine shaft and about which the pivoting disc 5 is pivotably supported on the sliding sleeve 9.

A driver 7 is fixed in a recess 2*a* of the machine shaft 2. The driver 7 projects approximately at a right angle from the machine shaft and extends, with a spherical articulation portion 7*a*, into a radially open receptacle 15 on the pivoting disc (cf. FIG. 2). Since the driver 7 is fixed to the machine shaft 2, the pivoting of the pivoting disc about the hinge axis 8 is coupled to the displacement of the sliding sleeve 9. When the reciprocating-piston machine is in operation, rotation of the machine shaft 2 is transmitted to the pivoting disc via the driver 7 (rotational movement in the direction of the arrow w).

A main center-plane extending through the axis of rotation 11 of the shaft 2 and perpendicularly to the hinge axis 8 separates a suction side of the reciprocating-piston machine from a pressure side. The main center-plane rotates with the machine shaft.

Figure 2:
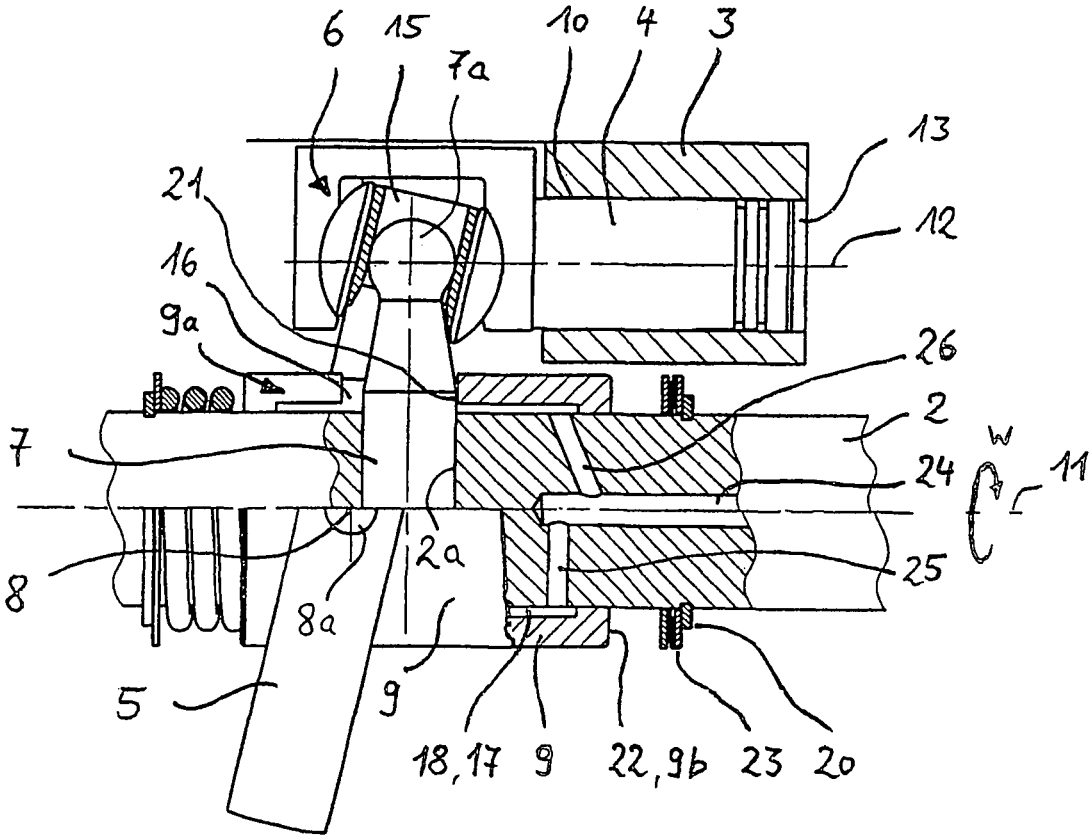
FIG. 2 shows a the reciprocating-piston machine according to FIG. 1 in a sectional view.

The pivoting disc 5 is surrounded on its circumference, in the region of each piston 4, by a joint arrangement 6 along which the pivoting disc 5 slides when it is rotated by the machine shaft 2. When the pivoting disc 5 is inclined in relation to the machine shaft 2 as illustrated in FIGS. 1 and 2, the pivoting disc, during its rotational movement, causes the pistons located on the pressure side to execute a compression movement and the pistons located on the suction side to execute a suction movement. FIG. 2 illustrates in a simplified manner the transmission of force between the machine shaft 2 and pistons 4.

Further particulars as to the design and the operation of the reciprocating-piston machine 2 may be gathered from U.S. Pat. No. 6,164,252, to which express reference is made hereby.

In the arrangement of the reciprocating-piston machine known from DE 197 49 727 A1, the driver extends through an elongated opening in the sliding sleeve and the sliding travel of the sliding sleeve is limited at opposite ends by the end faces of the elongated hole abutting against the driver. This means that the driver projects through the elongated hole and can be pressed into the machine shaft only after the sliding sleeve has been mounted onto the machine shaft. This causes considerable mounting problems.

Figure 3:
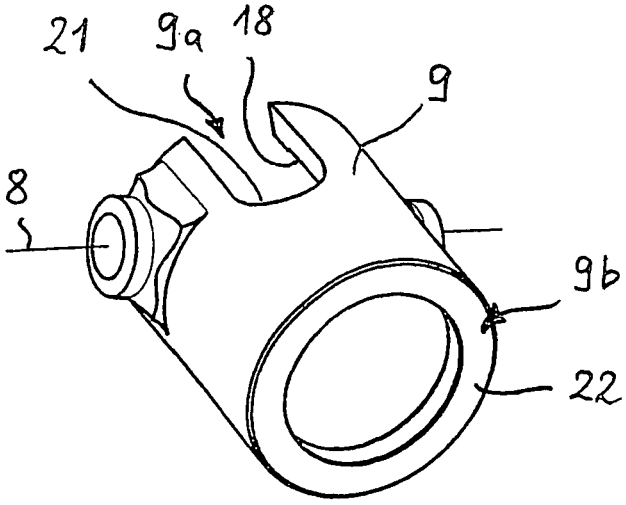
FIG. 3 shows a three-dimensional illustration of a sliding body of the reciprocating-piston machine.

In contrast, in the arrangement according to the present invention, the sliding sleeve 9 includes, instead of an elongated hole, a recess 9*a* which is open in the direction of the axis of rotation 11 of the machine shaft 2 and which, in the mounted state, partially surrounds the driver 7. Provided on the sliding sleeve 9, in the region of the recess 9*a*, is a first stop face 21 which, as illustrated in FIGS. 2 and 3, butts against the driver 7 when the sliding sleeve is in its first end position as shown in FIG. 2. The first end position of the sliding sleeve corresponds to an orientation of the pivoting disc 5 in which the pivoting disc 5 forms a minimum angle with the machine shaft 2 and the pistons execute a maximum stroke during rotation of the pivoting disc 5.

Furthermore, in the region of one end face 9*b* the sliding sleeve 9 has a second stop face 22, which abuts a holding element in the form of a retaining ring 20 forming a counter-piece on the machine shaft 2. Preferably, a spring element in the form of a weak cup spring 23 is provided between the retaining ring 20 and the stop face 22. When the sliding sleeve 9 is in its second end position, it butts against the cup spring 23 and compresses the latter approximately completely. In an embodiment without a spring element, the sliding sleeve butts directly against the retaining ring 20. When the sliding sleeve 9 reaches the second end position, the pivoting disc extends at least approximately at a right angle with respect to the machine shaft and is therefore in a "neutral position", in which the pistons of the reciprocating-piston machine are not moved by the pivoting disc 5. With the cup spring 23 being interposed, the pivoting disc 5 can be kept at some distance from its "neutral position" when the compressor is in the pressure-compensated state, so that the delivery action commences immediately when the system is activated. FIG. 3 illustrates the sliding sleeve 9 according to the invention in a perspective view. In the mounted state, the stop faces 21, 22 are arranged on the same side of the driver 7 in the direction of the axis of rotation 11.

Figure 4:
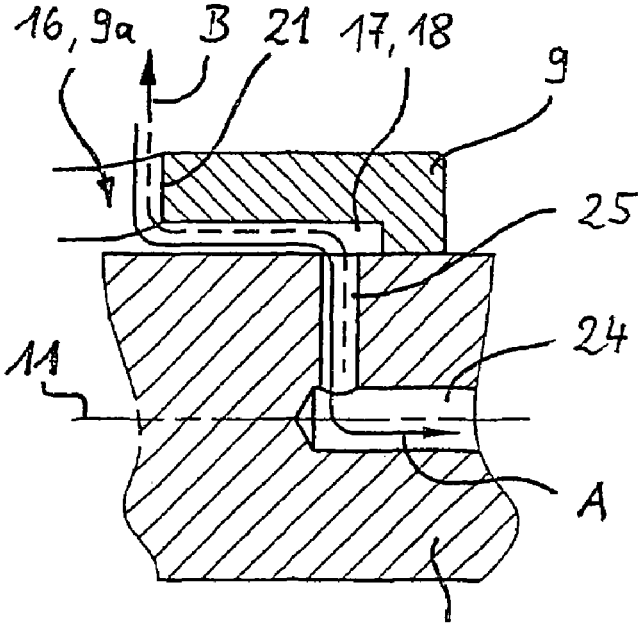
FIG. 4 shows parts of the sliding body and the machine shaft in a cross-sectional view in an operative position.
Figure 5:
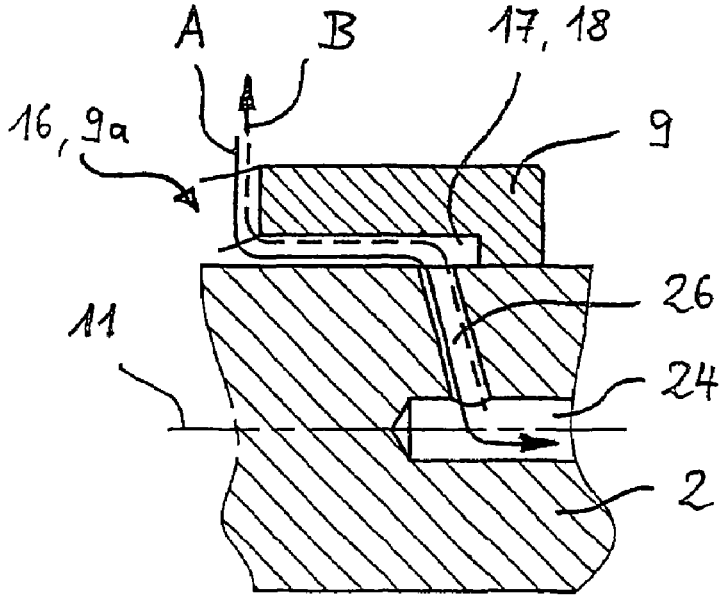
FIG. 5 shows a cross-section through a sliding body and a machine shaft, modified in relation to FIG. 5, of the reciprocating-piston machine.

The piston stroke and consequently the delivery volume of the reciprocating-piston machine 1 are changed by changing the pivoting angle of the pivoting disc 5. The pivoting angle changes preferably with the pressure in the drive space 14, which acts directly on the underside of the pistons 4. The delivery volume can therefore be controlled by the pressure in the drive space. This is carried out, for example, by the drive space 14 being constantly supplied through a small throttle (not illustrated), from the high-pressure side, with a small quantity of the working medium delivered by the reciprocating-piston machine, and by the quantity of the working medium flowing out of the drive space (depending on the conditions, towards the suction side) being controlled by means of a control valve. For this purpose, a discharge passage is provided within the machine shaft, formed by the bores 24, 25, via which the medium can be discharged from the drive space 14. FIG. 2 illustrates diagrammatically a further embodiment of a discharge line in the form of the bores 24, 26. The bores 24, 25, 26 can also be seen in detail in FIGS. 4 and 5.

Provided in a center region within the sliding sleeve 9 is an annular recess 18, which extends along the entire circumference over a large part of the inside of the sliding sleeve. In the assembled state (FIGS. 1, 2, 4 and 5), a cavity 17 is formed between the sliding sleeve 9 and the machine shaft 2. The cavity 17 is in communication with the drive space 14 by means of the recess 9*a* and, if appropriate, by means of further orifices. The bores 25, 26, which are offset axially to the recess 9*a*, extend through the machine shaft 2 radially inwards to the coaxial discharge bore 24, so that the drive space 14 is in communication with the dischage bore 24 via the bores 25, 26. The bore 25 in the shaft 2 is arranged in such a way that it extends perpendicularly to the axis of rotation 11, whilst the bore 26 extends at an inclination to the axis of rotation 11.

When the reciprocating-piston machine 1 is in operation, the drive space 14 generally contains not only the (preferably gaseous) working medium to be compressed by the reciprocating-piston machine, but also further liquid substances, such as lubricating oil and/or water. This may result undesirably in a mixture of the working medium with the liquid substances in the drive space. With the aid of the annular cavity 17 and the bores 25 and 26, in particular, liquid and/or solid substances can be precipitated from the working medium of the reciprocating-piston machine. The functions are explained in more detail in FIG. 4 and 5. The arrow A with an unbroken line depicts the path of the mixture, along which undesirable liquid and/or solid substances are precipitated, said substances returning to the drive space 14, particularly under gravitational influences, along a path denoted by the arrow B depicted by a broken line.

For the precipitation of undesirable substances in the cavity 17, the mixture must dwell for some time in this cavity. To this end, the bores 25, 26 are axially offset in relation to the inflow point into the cavity 17 near the recess 9*a*. The outward and return flows are separated in the cavity 17 by centrifugal force into an inner outward flow and an outer return flow. Separation of this kind also takes place particularly effectively in the bore 26 which for increased effectiveness is inclined to the axis of rotation 11. In the exemplary embodiment according to FIG. 5, the outflow bore 24 can be shorter, that is to say of lesser depth, than in the exemplary embodiment according to FIG. 4.

The sliding sleeve 9 can be slipped over the machine shaft and the driver, even when these are fixedly connected to one another. The driver can therefore be press-fitted into the machine shaft in a first mounting step that is before the machine is assembled or the machine shaft and the driver may be formed integrally as a single piece. Since the bending stress on the driver 7 extends into the associated recess in the shaft, so that, in the case of a press fit between driver and shaft, micro-displacements occur in the press-fit joint, the bending strength of the driver 7 can be increased and consequently bending reduced if the driver and shaft consist of one piece. A higher load-bearing capacity of the driver and shaft is obtained, thus resulting in an improved operating behavior of the reciprocating-piston machine.

Furthermore, a sliding sleeve according to the invention makes it possible, in conjunction with the discharge line in the machine shaft, to precipitate undesirable substances from the working medium of the reciprocating-piston machine, utilizing centrifugal-force and gravitational influences. Pure working medium can thus be discharged from the drive space, thereby resulting in improved controllability and therefore an improved operating behavior of the reciprocating-piston machine.

What is claimed is:

1. Reciprocating-piston machine, in particular a refrigerant compressor (1) for a motor vehicle air-conditioning system, comprising a machine shaft (2) rotatably supported in a machine housing, a plurality of pistons (4) arranged circularly around said machine shaft (2) in said machine housing (3), an annular pivoting disc (5) driven by the machine shaft (2) and engaging said pistons via joint arrangement (6), a driver (7) mounted on said machine shaft and being connected to said pivoting disc in an articulated manner for transmitting the drive forces to said pivoting disc (3) and a sliding body (9) axially movably supported on said machine shaft, said pivoting disc (5) being supported on said sliding body pivotably about a hinge axis (8) oriented transversely to the machine shaft, said sliding body (9) including an axially extending recess receiving said driver and being provided at its inside facing the machine shaft (2) with a cavity (17), which is in communication with a bore forming a discharge passage (24, 25, 26) extending through the machine shaft (2).

2. A reciprocating-piston machine according to claim 1, wherein said cavity (17) has an orifice (16) providing for communication with a drive space (14) of the reciprocating-piston machine, said orifice (16) being arranged at a distance, in the direction of an axis of rotation (11) of the machine shaft, from the exit of the discharge line (24, 25, 26) extending through the machine shaft (2).

3. A reciprocating-piston machine according to claim 1, wherein said orifice (16) is arranged in the region of said recess (9*a*).

4. A reciprocating-piston machine according to claim 1, wherein said sliding body (9) is provided at one end thereof with a stop face (22) and said machine shaft is provided with a stop (20) for limiting axial movement of said sliding body (9), and a cup-shaped spring element (23) is arranged between said stop (20) and said stop face (22) of the sliding body (9).

* * * * *